United States Patent [19]

Koenig

[11] Patent Number: 4,885,187

[45] Date of Patent: Dec. 5, 1989

[54] PROCESS FOR COATING ELECTRICAL BUS BARS AND THE LIKE

[75] Inventor: Timothy A. Koenig, St. Paul, Minn.

[73] Assignee: Minnesota Mining and Manufacturing Company, St. Paul, Minn.

[21] Appl. No.: 267,579

[22] Filed: Nov. 7, 1988

[51] Int. Cl.[4] ..... B05D 5/12; B05D 1/06; B05D 1/24; B05D 3/02

[52] U.S. Cl. ..... 427/58; 427/14.1; 427/29; 427/185; 427/195; 427/198

[58] Field of Search ..... 427/185, 197, 198, 29, 427/195, 14.1, 58

[56] References Cited

U.S. PATENT DOCUMENTS 3,866,307 2/1975 Pfahl et al. ..... 29/498

FOREIGN PATENT DOCUMENTS 59-215364 12/1984 Japan .
1471397 4/1977 United Kingdom .

OTHER PUBLICATIONS

Richart, D. S., "Powder Coatings", *Kirk-Othmer Encyclopedia of Chemical Technology,* 3rd Ed., 19, New York, John Wiley & Sons, 1982, pp. 1-27.

Arone, N. F. et al., "How G-E Insulates Bus Bars by Fluid Bed Process," *Insulation,* Nov., 1968, pp. 106-108.

"Heat Treating, Cleaning and Finishing," *Metals Handbook,* 8th ed., 2, American Society for Metals, Metals Park, Ohio, (1964), pp. 307-408.

"Near White Blast Cleaning," Specification SSPC-SP10, Steel Structures Painting Council, Pittsburgh, Pa., 1982.

Danielson, R. D., "Fluoro Ethers and Amines," *Kirk-Othmer Encyclopedia of Chemical Technology,* 3rd Ed., 10, p. 875, New York, John Wiley & Sons, 1980, p. 875.

Brighton, C. A., Marks G. C., and Benton, J. L., "Vinyl Chloride Polymers (Properties)", *Encyclopedia of Polymer Science and Technology,* 14, New York, John Wiley & Sons, Inc., 1971, pp. 407-433.

"Protech 1987 Catalogue," Protech Chemicals Limited (Canada), 1987.

"SCOTCHKOTE Fusion Bonded Epoxy Coatings", Publication No. 80-6102-1863-0, 3M, Apr. 1987.

"Powder Coatings", Publication Nos. MTD C78000-8/87 and MTD C70000-8/87, Morton Thiokol, Inc., 1987.

"3M's New Condensation Heating System . . . Applications," Publication 98-0211-4418-7(88.2)PDI, 3M, Aug. 1988.

"MOCAP Masking Devices . . . Masks", sales brochure, MOCAP, 1987.

*Primary Examiner*—Evan Lawrence

*Attorney, Agent, or Firm*—Donald M. Sell; Walter N. Kirn; Eloise J. Maki

[57] ABSTRACT

A process for coating a selected portion of the surface of a substrate, such as an electrical bus bar, with a coating of a fusible powdered resin. The process comprises the steps of heating the substrate to a temperature sufficient to cause gelling of a gelable liquid masking composition and to cause the fusible powdered resin to bond to the substrate surface, coating those areas of the surface of the substrate which are not to be coated with the fusible powdered resin with liquid masking composition which begins to gel upon contact with the hot substrate and continues to gel until it forms a removable mask, then coating the hot substrate with the powdered resin which adheres to those areas of the substrate that are not coated with the masking composition, cooling the substrate, and removing the mask from the substrate.

14 Claims, 3 Drawing Sheets

PROCESS FOR COATING ELECTRICAL BUS BARS AND THE LIKE

This invention relates to fusion-bonded powdered resin coating processes, such as those utilizing fluidized-beds, flocking, or electrostatic spray-coating methods, to apply a powdered resin coating to a preheated part. In another aspect it relates to the use of polyvinyl chloride masking compositions. In yet a further aspect, it pertains to the fluidized-bed coating of electrical bus bars.

Processes for coating selected surfaces of substrate with powdered resin, e.g. to electrically insulate substrates, are described by Richart, D.S., "Powder Coatings", *Kirk-Othmer Encyclopedia of Chemical Technology*, 3rd Ed., 19, John Wiley & Sons, (1982) pp. 1–27. Typically in these processes the coating powder, usually a thermoplastic or thermosetting resin, is applied to a substrate (e.g. a metal or plastic article), preheated (e.g., using an oven) to a temperature slightly above the melt temperature of the resin powder. The resin is generally applied to the substrate using fluidized-bed, flocking or electrostatic spray-coating methods. Typically in fluidized-bed coating, the resin powder is placed in a container with a porous plate at its base and air is passed through the porous plate fluidizing the powder. The substrate to be coated is heated, e.g. in an oven, to a temperature above the melting point of the powder and dipped into a fluidized bed where the powder particles melt and bond to the surface of the hot substrate to form a coating. In electrostatic coating, powder dispersed in an air stream is passed through a high voltage field where the powder particles pick up an electrostatic charge. The charged particles are then attracted to and deposited on the surface of a preheated or unheated substrate. In flocking, a mixed stream of air and powdered resin is blown, usually through a nozzle, on to the preheated substrate surface. Regardless of which coating method is used to deposit the powdered resin, the coated article may be further heated, e.g. in an oven, to completely melt, fuse, and/or cure the powdered resin coating. The substrate must at least be sufficiently heat resistant (e.g., resistant to deformation or degradation) to withstand temperatures required for fusion of the powdered resin. As a result, these processes have been primarily limited to metal and glass substrates although some plastics have been successfully powder-coated.

Fusion-bonded powdered resin coating processes can provide a convenient means to coat substrates with films of polymeric material, such as those required for electrical insulation. However, it is difficult to selectively coat areas of a substrate using these coating methods, particularly when fluidized-bed coating methods are used. Areas which are not to be coated should be masked prior to coating with powdered resin. For example, Arone et al. in, "How G-E Insulates Bus Bars by Fluid Bed Process", *Insulation*, Nov., 1968, pp. 106–108, describe an automated, commercial bus bar coating process. However, effective masking of substrates can be difficult, particularly because the mask material may be exposed to high temperatures during the process. High temperatures and handling could result in damage to the seal between the substrate and the mask, or in tearing, or cracking of the mask resulting in powdered resin depositing on areas of the substrate which were not to be coated.

Various methods have been used to mask substrates. Masking with tape and/or paper is labor intensive and the masks may not be sufficiently temperature resistant to withstand the cure temperatures required by powder coating processes. Another approach utilizes masking compounds or compositions, such as those comprising inorganic materials such as diatomaceous earth. These masking compositions can be applied to the masked areas by brush, but are labor intensive to remove since they must be washed off or mechanically removed by hand, e.g., by wire brushing. Also, these masking compositions may not be sufficiently durable to withstand the coating and curing process. Another approach utilizes preformed vinyl masks such as those manufactured by Mocap of St. Louis, Missouri. These preformed masks comprise sleeves and caps of various shapes which are slipped over the area to be masked. These masks are designed to stretch over the masked area to form a seal between the mask and substrate, however, they are only available in certain sizes and shapes. Therefore, suitable, preformed vinyl masks adapted to fit complex or unusually shaped masked areas may not be available.

Applicant's coating process, as will be apparent from the description thereof, has the capability of including as an in-line step the masking of the areas of a substrate, which are not supposed to be coated with a powdered resin coating, with a durable, heat resistant, easily applied, easily removable masking composition which effectively masks even complex and unusually shaped substrate areas. Applicants' invention satisfies a long-felt need of some industries for an improved fusion-bonded powdered resin coating process. This need has particularly been felt in those industries that coat substrates for which preformed masks are not available.

Applicant's process for coating a selected portion of the surface of a substrate, comprises the steps of:

(A) heating a substrate to a temperature that is sufficient to cause gelling of a gelable liquid masking composition and sufficient to cause a fusible powdered resin to bond to said substrate surface;

(B) subsequently coating with said liquid masking composition one or more selected areas of the surface of said substrate which are not to be coated with said fusible powdered resin, whereby said liquid masking composition begins to gel upon contact with the hot substrate and continues to gel or solidify until it forms a removable mask or coating;

(C) then coating the hot substrate with said fusible powdered resin, for example by disposing the substrate in a fluidized body of said fusible powder resin, whereby said powder resin is deposited on and adheres to one or more areas of the surface of the hot substrate that are not coated with said liquid masking composition;

(D) optionally, for reasons described below, further heating said substrate to maintain said temperature or to a higher temperature until said coating of powdered resin forms a cured coating;

(E) cooling said substrate; and (F) removing said mask from said substrate.

Preferably, removable, heat-resistant tape such as SCOTCH Brand Glass Cloth Tape No. 361 (available commercially from 3M Company, St. Paul, Minn.), is applied near all of the interfaces between the one or more area of the substrate to be coated with fusible powdered resin and their adjacent areas which ultimately are not to be coated with fusible powdered resin.

The tape is applied to the surface such that the tape overlies a surface not to be coated with powdered resin, but one edge of the tape is adjacent to and abuts the edge of an area which will be coated with fusible powdered resin to provide a sharp interface between the powdered-resin-coated and uncoated areas of the final substrate. One end of the tape is left free, i.e. not adhered to the substrate, to provide a tab to facilitate peeling of the mask from the surface of the substrate after coating. This tape can be removed either before or after step (D). Removal of the tape before step (D) results in the edge of the powdered resin coating adjacent to the mask flowing during the subsequent heating step (D) and forming a smooth edge.

The invention also comprises an apparatus for carrying out the process described above. The invention further comprises an applicator device for coating the liquid masking composition on the substrate.

In the accompanying drawings, FIG. 1 is a schematic view in elevation and partial cross-section which illustrates one embodiment of a coating apparatus useful for carrying out this invention.

FIG. 2 is a side view and FIG. 3 is a front view of an one embodiment of an application device which can be used to apply the liquid masking composition to a substrate such as n electrical bus bar.

FIGS. 4A, 4B, and 4C illustrate the method of using the device depicted in FIGS. 2 and 3 to apply the liquid masking composition to an electrical bus bar.

Figure 1:
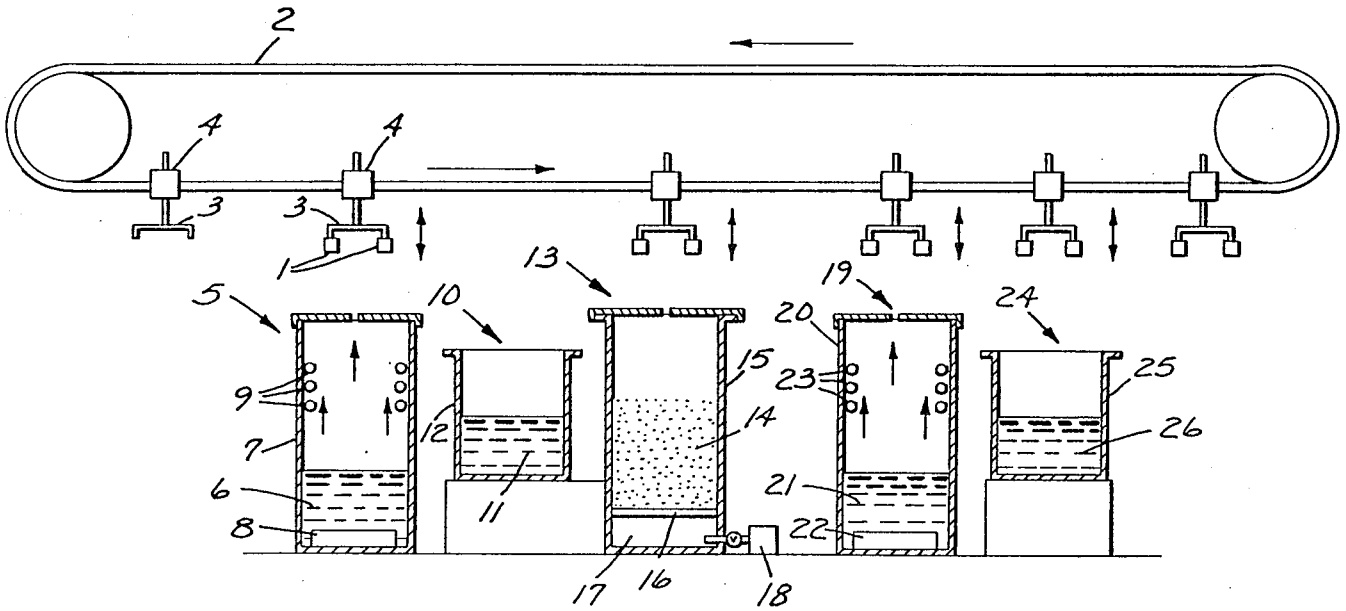

The features and benefits of this invention can be more easily understood by reference to the apparatus depicted in FIG. 1 and to FIGS. 2–10. As shown in FIG. 1, the substrate 1 to be coated can be mounted on an overhead conveyor 2 by an appropriate hangar 3. The conveyor 2 is adapted to move or convey each substrate 1 to a plurality of stations (described below) where the various steps of the process of this invention are carried out. Preferably said hanger 3 is attached to a motorized means 4 to lower and raise the substrate 1 into the various processing stations depicted in FIG. 1. One such motorized means 4 is a motorized screw-type conveyor which can raise and lower the hangar 3 and substrate 1. Preferably, either before or after attaching the substrate 1 to the hangar 3 but before conveying the substrate 1 to any of the processing stations, releasable, heat-resistant tape can be applied to the surface of the substrate near the interface between substrate areas to be coated with fusible powdered resin and substrate areas which will ultimately be uncoated with fusible, powdered resin.

In the above process, the substrate 1 is first conveyed to a heating station 5 for the heating the substrate 1. The substrate 1 can be heated using any conventional means of heating, e.g. an oven, but preferably, the heating station is a condensation heating unit because condensation heating units can heat the substrates very rapidly. Condensation heating units heat substrates by contacting said substrates with hot, inert vapor formed by boiling a stable, inert, organic liquid such as perfluorinated liquids. Condensation heating units suitable for use in this invention have been described in the art. For example, the condensation heating unit can be similar to vapor phase soldering equipment such as that described in U.S. Pat. No. 3,866,307 (Pfahl et al.). Preferably, said heating station 5 is a substantially closed vessel 7 containing a stable, inert, organic liquid 6, an immersion heater 8 for heating the liquid 6, and cooling coils 9 for condensing the stable, inert, organic liquid vapor before it can escape from the vessel 7. The condensation heating unit permits both containment of the vapor within the unit and recycling of the liquid 6.

The substrate 1 should be heated in the heating station 5 to a temperature which is at least equal to the gel temperature of a liquid masking composition 11 applied in the liquid masking composition coating station 10 described below. Said temperature should also be high enough to result in the fusible powdered resin 14 sticking to the hot substrate surface when the hot, masked substrate is disposed in a body of fluidized, fusible powdered resin in the powdered resin coating station 13 (described below). However, the substrate 1 should not be heated to a temperature that would result in the degradation of the liquid masking composition 11. Preferably, the temperature of the substrate 1 after the preheating step is 20° to 50° C. higher than the gel temperature of the liquid masking composition 11 to compensate for cooling of the substrate 1 occurring during the time it is conveyed, at ambient temperature, from the heating station 5 to the liquid masking composition coating station 10 and from the coating station 10 to the powdered resin coating station 13. Typically, the temperature of the substrate 1 after the heating station 5 would be about 150° C. to 250° C., and preferably, the temperature would be 175° C. to 225° C.

The liquid 6 used to form the hot, inert vapor in the heating station 5 may have a boiling point significantly above the gel temperature of the liquid masking composition 11 to facilitate rapid heating of the substrate 1. The selection of the liquid 6 will generally be determined empirically and can depend upon the surface area to volume ratio of the substrate, total mass of the substrate, and the final substrate temperature desired. However, the substrate temperature desired after heating is a primary factor determining selection of the liquid 6. The cost and availability of a liquid 6 may also be factors determining its selection.

After heating, the substrate 1 is conveyed to a liquid masking composition coating station 10 such as that depicted in FIG. 1. The coating of the substrate 1 with liquid masking composition 11 can be carried out using any conventional method used to coat a viscous liquid on a substrate such as dipping, flow coating, spraying, or brushing. Dipping and flow coating methods are preferred because they are generally simple and are not labor intensive. The liquid masking composition coating station 10 depicted in FIG. 1 comprises a vessel 12 filled with a liquid masking composition 11. That portion of the substrate 1 which is not to be coated with the fusible powdered resin is dipped into the liquid masking composition 11 to apply a liquid masking composition coating.

Figure 3:
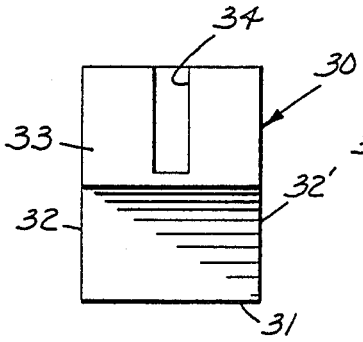
Figure 2:
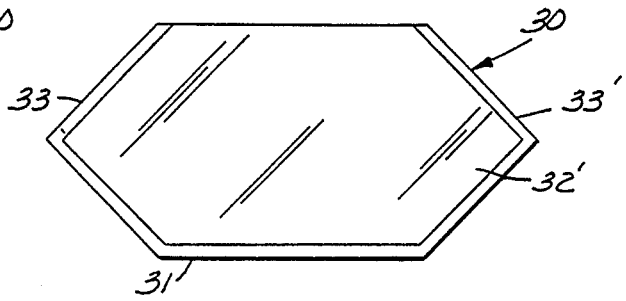

Another apparatus for coating liquid masking composition on a substrate is the application device depicted in FIGS. 2 and 3. FIG. 2 is a side view and FIG. 3 is an end view of said device 30 that can be used for flow coating liquid masking composition on to the ends of various substrates, but particularly on to the ends of electrical bus bars. The device 30 is a vessel having a bottom 31, two sides 32, 32' and two ends 33, 33' which are joined together along their edges to form an open vessel for containing liquid masking composition. One of said ends 33 is provided with a slot 34 which extends from the top edge of said end about halfway down said end 33. Said slot 34 is wide enough to receive the end of the substrate. The size and precise shape of said device 30 is determined by the size and shape of the end of the substrate. Clearly, the size and shape need to be sufficiently large to receive the end of the substrate.

Figure 4A:
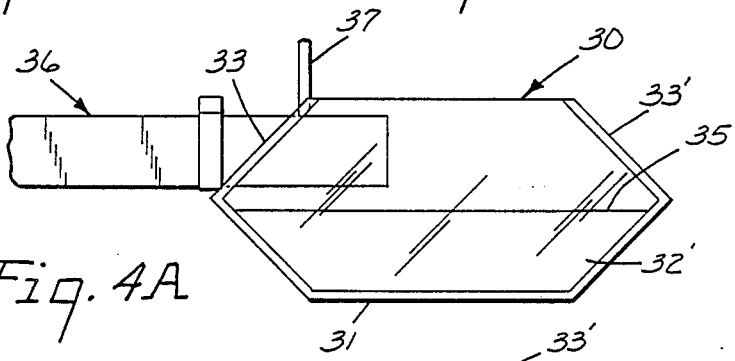
Figure 4B:
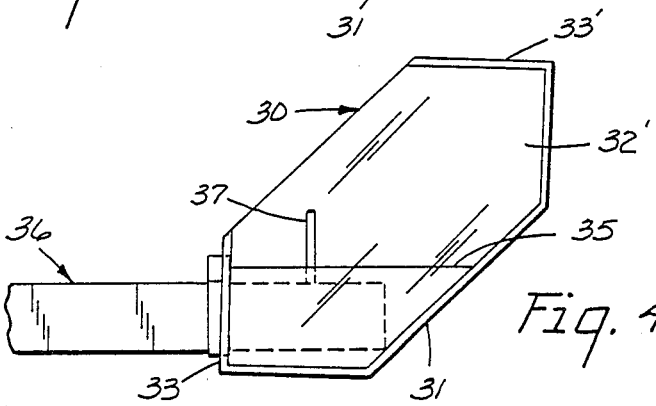
Figure 4C:
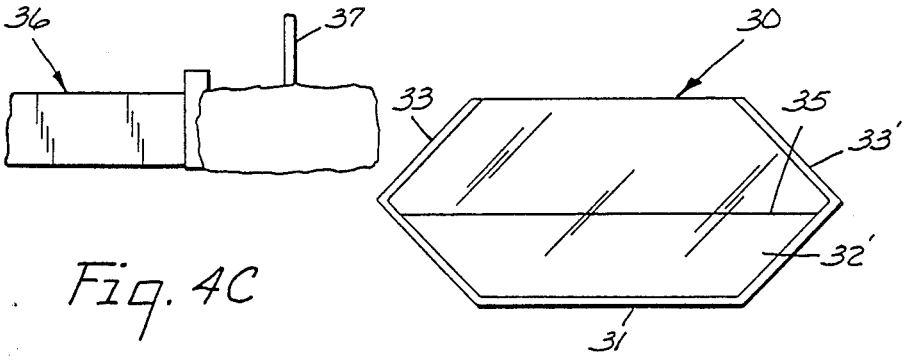

FIGS. 4A–4C illustrate the use of the device 30 with an electrical bus bar 36. As shown in FIG. 4A, while the hot bus bar 36 is suspended from a conveyor via hanger 37, the device 30 can be lifted to the bus bar 36 and the bus bar 36 is inserted into the slot 34. The device 30 should be filled with liquid masking composition 35 to a level no higher than the bottom edge of the slot 34. The device 30 is then tipped by hand or by an appropriate mechanical means until the liquid masking composition 35 flows over the end of the bus bar 36. After coating, the device 30 is returned to its starting position and the bus bar 36 is removed from the slot 34.

Referring again to FIG. 1, almost immediately (e.g., within about five seconds) after coating the hot substrate 1 with the liquid masking composition 11, the liquid masking composition 11 begins to gel. If said composition does not rapidly begin to gel, it may run off the substrate surface. Hence, it is important to heat the substrate sufficiently before coating with liquid masking composition to ensure the rapid gelling of said composition.

Depending upon the surface area to volume ratio of the substrate, the temperature of the substrate, and the type of liquid masking composition used, the time required for said composition to substantially solidify will vary. Generally, it will take less than one minute for the liquid masking composition to substantially solidify and form a peelable mask. The resulting mask should be sufficiently thick to insulate the hot substrate and thereby prevent the fusible powdered resin from sticking to and building up in a thick layer on the mask when the fusible powdered resin is coated onto the hot substrate. However, the liquid masking composition 11 does not need to be completely solidified before the substrate is coated with fusible powdered resin. Generally, final mask thickness is 0.025 to 0.15 cm.

After masking the substrate 1, the hot substrate is conveyed to a fusible powdered resin coating station 13. A fusible powdered resin coating can be deposited on the hot, masked substrate using any conventional method of applying fusible powdered resins and can be similar to those described in the art, (for example in Richart, D.S., "Powdered Coatings" pp. 16–20). For example, fluidized-bed coaters, flocking coaters, and electrostatic coaters are all useful in this invention. Preferably, a fluidized-bed coater such as that depicted in FIG. 1. is used in this invention. Generally, such a coater comprises a substantially closed vessel 15 containing a porous plate 16. Below the porous plate 16 is a plenum 17 into which air is blown using any conventional means such as a compressor 18. The hot, masked substrate 1 must be hot enough before being placed in the station 13 to cause sufficient fusible powdered resin 14 to fuse or stick and to bond or adhere to its surface. The residence time of said substrate in station 13 must be sufficient to permit the fusible powdered resin to build up on its surface to the desired final coating thickness. The final coating thickness should be sufficient to adequately perform in its desired final use. For example, coatings which are applied for the purpose of providing electrical insulation should be sufficiently thick to electrically insulate the substrate, e.g., about 0.076 to 0.32 cm thick.

If additional melting or curing of the resin coating is necessary, the masked, resin coated substrate 1 can be conveyed to a another heating station 18. In this station, the substrate 1 can be heated to maintain the temperature of the substrate or can be heated to a higher temperature than that achieved in station 5. Any conventional method, like those described herein, can be used to heat the substrate 1, but preferably a condensation heating unit is used. Preferably, the heating station 19 is similar to the heating station 5, described above, in that it comprises a substantially closed vessel 20, containing an inert, stable, organic, liquid 21, an immersion heater 22 for heating the liquid 21, and cooling coils 23 for condensing vapor formed by heating the liquid 21 before it can escape from the vessel 20. In addition, it can include a radiant energy source such as a UV light if the resin coating is UV curable. The liquid 21 used in the heating station 19 need not be the same as that used in the heating station 5 first used to heat substrate 1. Selection of the liquid for the station 19 can depend not only on the factors described above but also on whether the resin coating is to be cured in the station 19 or whether the coating is only further melted in this step. If only melting is desired, it may be desirable to select a liquid with a boiling point just above the melting point of the powdered resin. If the coating is to be cured, it may be desirable to select a liquid with a boiling point just above the cure temperature of the powdered resin if that temperature is different from the melting temperature. If releasable heat resistant tape was applied to the substrate 1, preferably it is removed before the substrate is lowered into the heating station 19.

After coating the substrate 1 with the fusible powdered resin 14 and optionally further heating the substrate in the heating station 19, the substrate 1 is conveyed to a cooling station 24. Any conventional cooling method can be used to cool the coated substrate 1, such as cool or refrigerated air or liquid cooling media, to a temperature at which the mask can be easily and cleanly peeled from the mask. Preferably, this temperature is less than 80° C. Preferably the cooling station 24 is a water bath. In the preferred embodiment, the cooling station 24 comprises a vessel 25 and water 26. After quenching or cooling, the mask can be removed from the substrate by manually or mechanically stripping or peeling.

Figure 5:
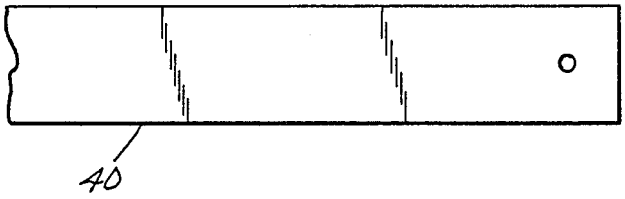
FIGS. 5 through 9 show side views of an end of an electrical bus bar as it would appear after various stages of applicant's process.
Figure 6:
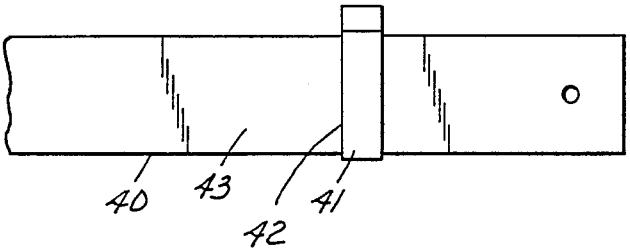
Figure 7:
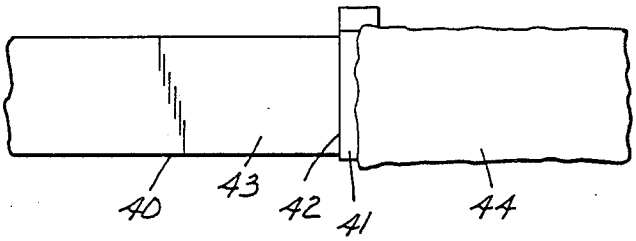
Figure 8:
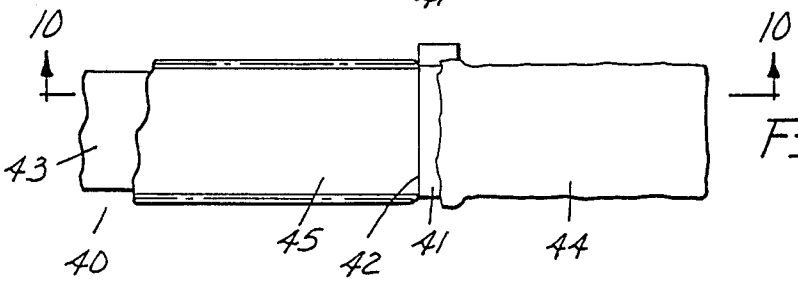
Figure 9:
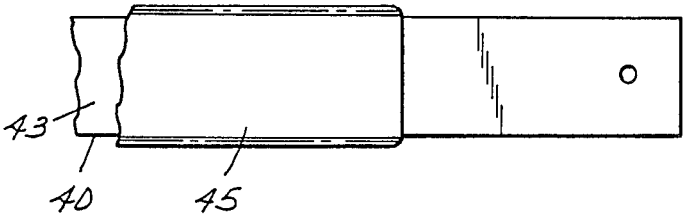
Figure 10:
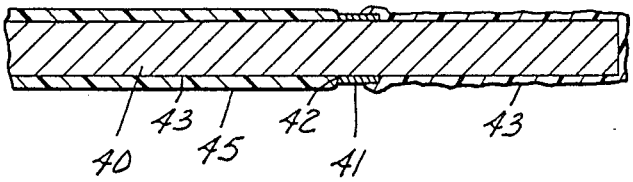
FIG. 10 shows a cross-sectional view of the electrical bus bar shown in FIG. 8 taken along plane 10—10.

FIGS. 5–10 depict an electrical bus bar at various stages of the process of this invention. FIG. 5 shows the end of an electrical bus bar 40 as it would appear before subjecting it to applicant's process. FIG. 6 shows the electrical bus bar 40 after the optional taping step described above wherein a heat-resistant tape 41 is applied to the bus bar 40 so that an edge 42 of the tape 41 is placed adjacent to the edge of the area 43 of the bus bar 40 which will ultimately be covered with the fusible powdered resin. FIG. 7 shows the electrical bus bar 40 after a liquid masking composition has been applied and has gelled to form a peelable mask 44. FIG. 8 shows the electrical bus bar 40 after the fusible powdered resin coating 45 has been applied. FIG. 8 does not show the fusible powdered resin coating overlapping areas of the electrical bus bar 40 already covered by the tape 41 and the mask 44. Generally some of the fusible powdered resin will also be deposited on the tape 41 and the mask 44. However build up of fusible powdered resin on the mask 44 will be limited because the mask thermally insulates the bus bar 40. FIG. 10 shows a cross-sectional view of FIG. 8 taken at plane 10—10 FIG. 9 shows the electrical bus bar 40 after the removal of the mask 44 and tape 41.

Substrates suitable for use in this invention include rigid or flexible materials such as primed or unprimed metals (e.g., steel, copper, or aluminum), glass, ceramics, and plastics which can withstand the process temperatures of this invention, such plastics including polycarbonates, polysulfone, and selected polyamides and polyimides.

The surfaces of substrates coated using the process of this invention may need to be prepared for coating to improve adhesion or bonding of the coating to the substrate. Surface preparation may include cleaning the surface of the substrate of any corrosion, oxidation, mill scale, grease, oil, drawing compounds, rust inhibitors or soil that might prevent good wetting of the surface by the powdered resin or the liquid masking composition. Surface preparation methods are well known and many have been described, for example, in "Heat Treating, Cleaning and Finishing", *Metals Handbook*, 8th ed., Vol. 2, American Society for Metals, Metals Park, OH., 1964) pp. 307–408, and in *Near White Blast Cleaning*, Specification SSPC-SP10, Steel Structures Painting Council, Pittsburgh, Pa., 1982. The substrate area to which the fusible powdered resin is applied should be primed, if necessary, to make the resin coating adhere to the substrate. However, the area to be coated with the liquid masking composition need not be primed since the mask should peelable from the surface of the substrate. Generally the selection of substrate material and fusible powdered resin coating material will determine whether a primer is required. For example, metal substrates made of steel may need to be primed before they are coated with a tthermoplastic powdered resin but may not need to be primed before they are coated with a thermosetting powdered resin.

The stable, inert, organic liquid useful in this invention must be chemically stable. That is, the liquid and its vapor will not react with the liquid masking composition, substrate, or fusible powdered resin at process conditions, e.g. temperature. In addition, the organic liquid and its vapors must be thermally stable, i.e., not degrade or decompose at high temperature when heated to temperature at or near their boiling points (i.e., within 50° C.). The liquids can be selected from the representative class of fluorinated linear, branched or cyclic alkanes, ethers, tertiary amines, and aminoethers, and mixtures thereof. Preferably, perfluorinated chemicals are used in this invention, though partially fluorinated chemicals can also be used. The perfluorinated chemicals can be straight chain, branched chain, or cyclic, or a combination thereof such as alkylcycloaliphatic, and are saturated, that is, free of ethylenic, acetylenic, and aromatic unsaturation. The skeletal chain can include catenary oxygen and/or trivalent nitrogen heteroatoms providing stable links between fluorocarbon groups and not interfering with the inert character of the compound. Also blends or mixtures of the stable, inert, organic liquid can be used in this invention. Generally the boiling point of liquids suitable for use in this invention are between 150°–300° C., and preferably between 150°–260° C.

Many useful liquids are commercially available and include "FLUORINERT" electronic liquids, "3M" brand Condensation Heating Fluid both from 3M Company, "FREON E" liquids from E.I. duPont de Nemours 7 Co., "FLUTEC PP" liquids from ISC Chemicals Limited, and "GALDEN HS" liquids from Montedison, Inc.

A list of preferred inert, stable, perfluorochemical liquids and their boiling points is shown below. Some of the boiling point data is taken from R.D. Danielson, "Fluoro Ethers and Amines", *Kirk-Othmer Encyclopedia of Chemical Technology*, 3rd Ed., 10, p. 875, John Wiley & Sons (NY, 1980).

| Liquid | Boiling point, °C. |
|---|---|
| Perfluoromethyldecalin | 165 |
| Perfluorofluorene | 192 |
| Perfluorinated polyethers | 150–250 |
| Perfluorotributylamine | 178 |
| Perfluorohexyl ether | 181 |
| Perfluorotetrahydrophenanthrene | 215 |
| Perfluorotriamylamine | 215 |
| Perfluorotrihexylamine | 253 |

The liquid masking composition should be gelable, that is it should gel almost immediately after contacting the preheated substrate surface and substantially solidify to form a thermally stable coating or mask which is sealed or bonded to the substrate surface and remains so bonded until it is desired to peel the mask off the substrate. To facilitate application, the liquid masking composition should have a sufficiently low viscosity at ambient temperature to allow it to be evenly coated onto the surface of the preheated substrate, yet not so low that it flows off the substrate surface before gelling. Representative liquid masking compositions are liquid plastisols or organosols. Plastisols and organosols are known compositions and have been described in the art, see for example, Brighton, C. A., Marks, G. C., and Benton, J. L., "Vinyl Chloride Polymers (Properties)", *Encyclopedia of Polymer Science and Technology*, 14, pp. 407–433, John Wiley & Sons, Inc., (NY, 1971). Briefly described, plastisols and organosols are colloidal suspensions comprising polyvinylchloride resin (PVC) and plasticizer, and optionally, stabilizer, pigment or dyestuffs, lubricant, and filler. Typically, plastisol and organosol compositions can contain 30 to 50 weight % plasticizer (e.g., phthalates) and 3–5 parts per hundred parts of polyvinyl chloride (PVC) of stabilizer (e.g., basic lead carbonate). Organosols are plastisols diluted with a small amount nonsolvating, volatile diluent such as an aliphatic or naphthenic liquid in the mineral spirits range. Generally plastisols and organosols are liquids or pastes at room temperature but preferably, the organosols and plastisols used in this invention are liquid at room temperature. Generally, the plastisols used in this invention gel at temperatures between 150° C. and 250° C. and preferably between 175° C. and 225° C. Some of the plastisols suitable for use in this invention are commercially available from Dennis Chemical Co. of St. Louis, Missouri as "DENFLEX-PX-8063-B", from Plastomeric, Inc. of Sussex, WI as "DX 2308", from Michigan Chrome & Chemical Company of Detroit, MI as "Microsol E-1000", and from Rutland Plastic, Division of Dexter Corp. of Charlotte, NC as "RDP 1388-2".

The fusible powdered resins useful in this invention comprise any of those thermoplastic and thermosetting resins suitable for application in fusion bonding processes. These resins have been described in the art (see for example Richart, D. S., "Powder Coatings" pp. 2–13). Some representative thermoplastic powdered resins are polyamides (e.g., nylon-6, nylon-6,6, and nylon-11), selected polyesters (e.g., terephthalic acid-1,4-butanediol copolymers), plasticized polyvinyl chlorides, and polyolefins (e.g., polyethylenes and polypropylenes). Representative thermosetting powdered resins are epoxies, polyurethanes, selected polyesters, epoxy-polyester hybrids, and acrylics. Among other factors, the selection of fusible powdered resin will depend upon the final properties desired in the final coating, e.g., electrical properties, impact resistance, or chemical resistance. Powdered epoxy resins are one of the most commonly used fusible powdered resins in fusion bonding processes and are particularly preferred for coating electrical bus bars. Nylon resins are also commonly used in fusion bonding processes and are particularly preferred for coating the splines of heavy equipment drive trains.

Some of the epoxy resins useful in this invention are available commercially from 3M Company of Saint Paul, Minn. as "Scotchkote" fusion bonded epoxy coatings 134, 213, 214, 203, 206N, from Protech Chemicals Limited of Saint-Laurent, Quebec, Canada as "E SERIES" epoxy powder coatings; from Morton Thiokol, Inc. as "CORVEL" 82033; and from the Hysol Division of Dexter Corporation as DK 14-0463. Some of the nylon resins useful in this invention are available commercially from Thermoclad Company of Erie, Pa. as "DURALON" Nylon 11 powder; and from Morton Thiokol, Inc. of Reading, Pa. as "CORVEL" 70000/75000 Series fluidized bed grade nylon powders, or "CORVEL" 78000 Series electrostatic grade nylon powders. Some of the polyester powdered resins useful in this invention are available commercially from Protech Chemicals Limited as "P SERIES" polyester powder coatings. Some of the polyurethane powdered resins useful in this invention are available from Protech Chemicals Limited as "U SERIES" polyurethane powder coatings. Some of the hybrid polyester and polyurethane powdered resins useful in this invention are available commercially from Protech Chemicals Limited as "H SERIES" hybrid powder coatings. The Protech Chemicals Limited resins are described in the "Protech 1987 Catalogue". The 3M Company resins are described in "SCOTCHKOTE Fusion Bonded Epoxy Coatings", publication 80-6102-1863-0. The Morton Thiokol, Inc. resins are described in "Powder Coatings" publication numbers MTD C78000-8/87, MTD C70000-8/87.

This invention is particularly useful for applying electrically insulative coatings on electrical bus bars, and electric motor armatures.

The following example is offered to aid in a better understanding of the present invention and is not to be unnecessarily construed as limiting the scope thereof.

EXAMPLE

This example describes the coating of a 76.2 cm×5.1 cm×0.64 cm aluminum bus bar with an epoxy, powdered-resin coating. The bar was made of aluminum flat stock and each end of the bar had a 0.64 cm diameter hole bored through the bar about 2.54 cm from each end. The holes serve as electrical connections to the bars in their final use as electrical bus bars and also serve as points from which the bar is attached to the conveyor used to transport the bars through the process apparatus. The bars were bolted to hangers extending from the conveyor through each of the holes. Before mounting the bars on the conveyor, two pieces of 1.9 cm wide "SCOTCH" brand No. 361, heat resistant, glass cloth tape were applied near the ends of the clean bar. The tape pieces were placed at each edge of that portion of the bar which was to be coated with the powdered epoxy resin coating. The taped bar was then mounted on the conveyor and conveyed to a condensation heating unit where it was mechanically lowered into the unit. The bar was lowered into vapor formed from boiling "3M" brand Condensation Heating Fluid perfluorinated fluid CH-8420, boiling point 218° C., available from 3M Company, Saint Paul, Minn. The entire length of the bar was immersed in the vapor. The bar remained immersed in the vapor for 1.5 minutes until it reached a temperature of about 215° C. Then the bar was mechanically lifted from the condensation heating unit. Each end of the bar was coated with DENEFLEX PX-8063-B plastisol using the apparatus depicted in FIGS. 2–4C. The ends of the bar were submerged into the plastisol to a depth sufficient to cause the plastisol coating to overlap the edge of each tape piece. The plastisol coatings immediately began to gel. The plastisol coating thicknesses were about 0.10 cm thick. The masked bar was then conveyed to a fluidized bed coater and mechanically lowered into said apparatus where it was coated with DK 14-0463 epoxy resin available from Dexter Hysol. In order to achieve the proper coating thickness of the epoxy resin, the bars were suspended in the fluidized bed for three, 6 second intervals. The tape pieces were then removed from the bar and the resin coated bar was conveyed back to the condensation heating unit described earlier and lowered into the vapor formed from the CH-8420 fluid to completely melt and cure the epoxy resin coating. The bar remained suspended in the condensation heating unit approximately 1 minute. The bar was then mechanically removed from the heating unit, then conveyed to a water bath and mechanically lowered into the 25° C. water. The bar cooled to about 80° C. after 1 minute in the water bath and then was removed. After cooling, the plasticized masks were manually peeled away from the bar and the conveyor hangers.

Alternatively, an identical bar was prepared according to a procedure similar to that described above except that the tape pieces were removed after the bar was coated with the epoxy resin powder. When the bar was subsequently heated in the condensation heating unit, the epoxy resin reflowed at the edges which had been adjacent the tape pieces, thus forming smooth edges.

Various modifications and alterations of this invention will become apparent to those skilled in the art without departing from the scope and spirit of this invention.

I claim:

1. A process for coating selected portions of the surface of a substrate comprising the steps of:

(A) heating a substrate to a temperature that is sufficient to cause gelling of a gelable, liquid masking composition and sufficient to cause a fusible powdered resin to bond to said substrate surface;

(B) subsequently coating with said liquid masking composition one or more areas of the surface of said substrate which are not to be coated with said fusible powdered resin, whereby said liquid masking composition begins to gel upon contact with the hot substrate and continues to gel until it forms a removable mask;

(C) then coating the hot substrate with said fusible powdered resin, whereby said fusible powdered resin is deposited on and adheres to one or more areas of the surface of said substrate that are not coated with said liquid masking composition;

(D) cooling said substrate; and (E) removing said mask from said substrate.

2. The process of claim 1 wherein said step of removing is performed by peeling said mask off said substrate.

3. The process of claim 1 wherein said hot substrate is coated in step (C) by disposing said hot substrate in a fluidized body of said fusible powdered resin.

4. A process according to claim 1 further comprising a second step of heating said substrate wherein said substrate is heated after step (C) to maintain said temperature or to increase said temperature, until said fusible powdered resin forms a cured coating.

5. A process according to claim 1 further comprising a step before step (A) of applying removable, heat resistant tape to the surface of said substrate adjacent to the interfaces between the areas of said substrate surface to be coated with fusible powdered resin and their adjacent area of said substrate surface not to be coated with fusible powdered resin, such that one edge of said tape abuts said interfaces and overlies said areas of said substrate surface not to be coated with fusible powdered resins.

6. A process according to claim 5 wherein said process further comprises:

a second step of heating said substrate wherein said substrate is heated after step (C) to maintain said temperature or to increase said temperature, until said coating of fusible powdered resin forms a cured coating; and a step of removing said tape after step (C) and before said second step of heating.

7. A process according to claim 1 wherein the heating of the substrate in step (A) is accomplished through the condensing of hot, inert, stable, organic vapor on said substrate surface.

8. A process according to claim 7 wherein said vapor is formed by boiling a perfluorinated liquid.

9. A process according to claim 1 wherein said liquid masking composition is selected from the group consisting of plastisols and organosols.

10. A process according to claim 1 wherein said temperature sufficient to cause gelling, of said liquid maskant composition and to cause said powdered resin to bond to said substrate surface is 150° C. to 250° C.

11. A process according to claim 1 wherein said temperature is 175° to 225° C.

12. A process according to claim 1 wherein said powdered resin is a thermoplastic or thermosetting resin.

13. A process according to claim 12 wherein said powdered resin is selected from the group consisting of epoxies, polyamides, polyesters, polyvinyl, chlorides, polyurethanes, acrylics, and epoxy-polyester hybrids.

14. A process according to claim 1 wherein said substrate is an electrical bus bar, said liquid masking composition is a plastisol, said fusible powdered resin is an epoxy resin, and said temperature sufficient to gel said liquid masking composition and to cause said fusible powdered resin to stick to said substrate surface is 175° C. to 225° C.

* * * * *